US005103531A

United States Patent [19]

Perrotta

[11] Patent Number: 5,103,531

[45] Date of Patent: Apr. 14, 1992

[54] SHOWER BOW

[76] Inventor: Joseph Perrotta, 3101 S.W. 117 Ave., Davie, Fla. 33330

[21] Appl. No.: 677,995

[22] Filed: Apr. 1, 1991

Related U.S. Application Data

[63] Continuation-in-part of Ser. No. 572,423, Aug. 27, 1990, abandoned.

[51] Int. Cl.[5] ..... A47H 13/00

[52] U.S. Cl. ..... 16/87.4 R; 16/87 R; 4/605; 4/608

[58] Field of Search ..... 16/87.4 R, 87 R; 4/605, 4/608, 609

[56] References Cited

U.S. PATENT DOCUMENTS

| | | | |
|---|---|---|---|
| 1,003,763 | 9/1911 | Leo | 4/608 |
| 3,140,557 | 7/1964 | Albrycht | 4/605 |
| 4,229,842 | 10/1980 | Gilmore | 4/610 |
| 4,361,914 | 12/1982 | Oliver | 4/605 |
| 4,754,504 | 7/1988 | Cellini | 4/605 X |

*Primary Examiner*—Richard K. Seidel
*Assistant Examiner*—Patty E. Hong

[57] ABSTRACT

A shower bow apparatus consisting of a rigid high impact rod which forms an horizontal bow causing a shower curtain to be held out from the showering area. The rod is held in place in use by inserting the ends into angled bores in brackets attached to the walls. Various storage devices are provided for storing the rod when not in use.

3 Claims, 5 Drawing Sheets

SHOWER BOW

The present application is a continuation in part of application entitled SHOWER BOW Ser. No. 572,423 filed on Aug. 27, 1990 and now abandoned.

BACKGROUND OF THE INVENTION

1. Field of the Invention

Bathtubs and stall showers that use a shower curtain loosely hanging from a shower curtain bar are all of poor design. When the shower water raises the air temperature in the showering area it creates an air flow movement up and out of the showering area. It is replaced with cool air from outside the showering area. This causes the shower curtain to come into the showering area. This invention will correct this poor design of the shower curtain. In all forms of my invention the rigid high impact rod is put in the brackets the rod will bow and form a horizontal self supporting rigid arch this then will prevent the shower curtain from coming into the showering area. This present invention can be used in any stall or tub shower or anywhere else a shower curtain is used.

I show three different shower configurations. One being the conventional tub shower installation consisting of three vertical walls and a horizontal bar mounted by end supports and a loosely hung shower curtain directly above the leading edge of the tub. Two being a two vertical wall shower unit with a shower curtain rod mounted by end supports directly above the leading edge of the shower drain base. Three being a one vertical wall shower unit with a shower curtain rod mounted by end supports directly above leading edge of the drain base.

In some showering area the present invention will enlarge the shower area to provide a greater stall space for body movement.

2. Description of the Prior Art

U.S. Pat. No. 4,754,504 this invention enlarges the shower area but fails to correct the poor design of shower curtain.

U.S. Pat. No. 4,361,914 this device does prevent the movement of a flexible shower curtain but this patent does not show a one-piece self supporting horizontal arch that can be used in one or two wall shower unit or anywhere a shower curtain is used.

U.S. Pat. No. 4,229,842 Gilmore teaches a device he refers to as a shower curtain adapter for expanding the showering space within a shower enclosure. Referring to FIG. 1, a flexible adapter rod 3 is pressure mounted between the right and left hand vertical walls by rubber tips 9 to provide friction causing the adapter rod to bow outward. This rod 3 is vertically supported by a ball chain 4 to prevent downward gravity movement and a hollow vertical tube 2 to prevent upward movement. This patent does not show a one piece self supporting horizontal arch that can be used any where a shower curtain is used. Without the ball chain and hollow vertical tube this device will not efficiently support and maintain a shower curtain.

DETAILED DESCRIPTION OF THE PREFERRED EMBODIMENTS

Figure 1:
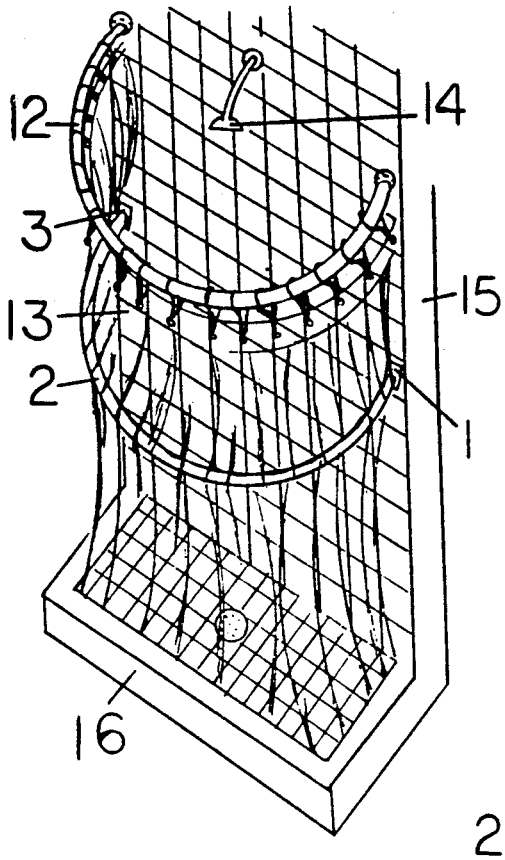
FIG. 1 is a view of a one wall shower unit with a shower curtain hanging from a horizontal bar mounted by end supports directly above the leading edge of the drain base and illustrating the present invention.

Referring in more detail to the drawings, FIG. 1 shows the invention in its operative position as applied to a one wall stall shower. Drain base 16 is connected to vertical wall 15 and a standard shower head 14 mounted on wall 15 and a standard shower curtain bar 12 mounted by end supports about 66 inches directly above the leading edge of the drain base 16 with shower curtain 13 surrounding the drain base 16 to prevent water from escaping from the showering area. The high impact rigid rod 2 is mounted in brackets 1 and 3 that are mounted on wall 15, 30 inches below bar 12 this will prevent the shower curtain from coming in on the showering area.

Figure 2:
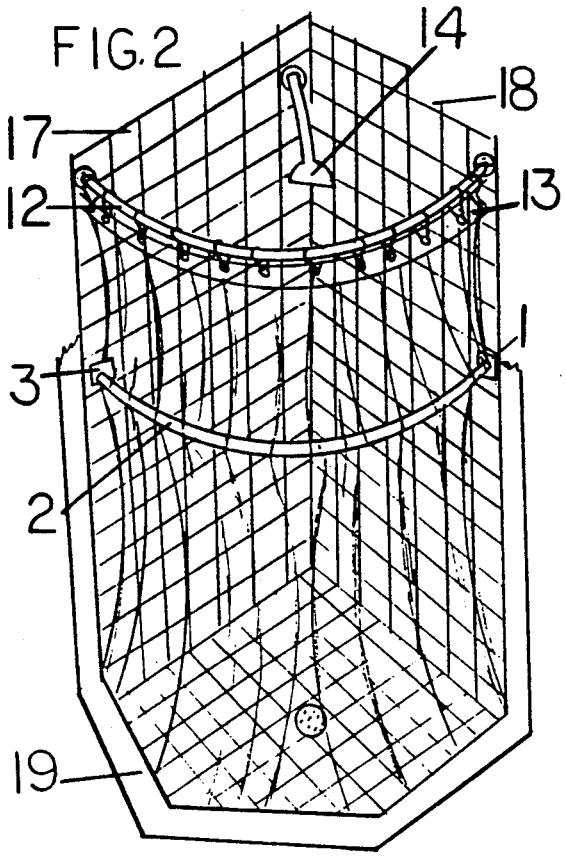
FIG. 2 is a view of a two wall shower unit with a shower curtain hanging from a horizontal bar mounted by end supports directly above the leading edge of the drain base and illustrating the present invention.

FIG. 2 shows the invention in its operative position as applied to a two wall stall shower. Drain base 19 is connected to vertical walls 17 and 18, and standard shower head 14, mounted on the walls 17 and 18 is a standard shower bar 12 mounted by end supports about 66 inches directly above the leading edge of the drain base 19 with shower curtain 13 hanging from bar 12. The high impact rigid rod 2 is put in to the brackets 1 and 3 that are mounted on walls 17 and 18 30 inches below bar 12, this will prevent the shower curtain from coming into the showering area.

Figure 3:
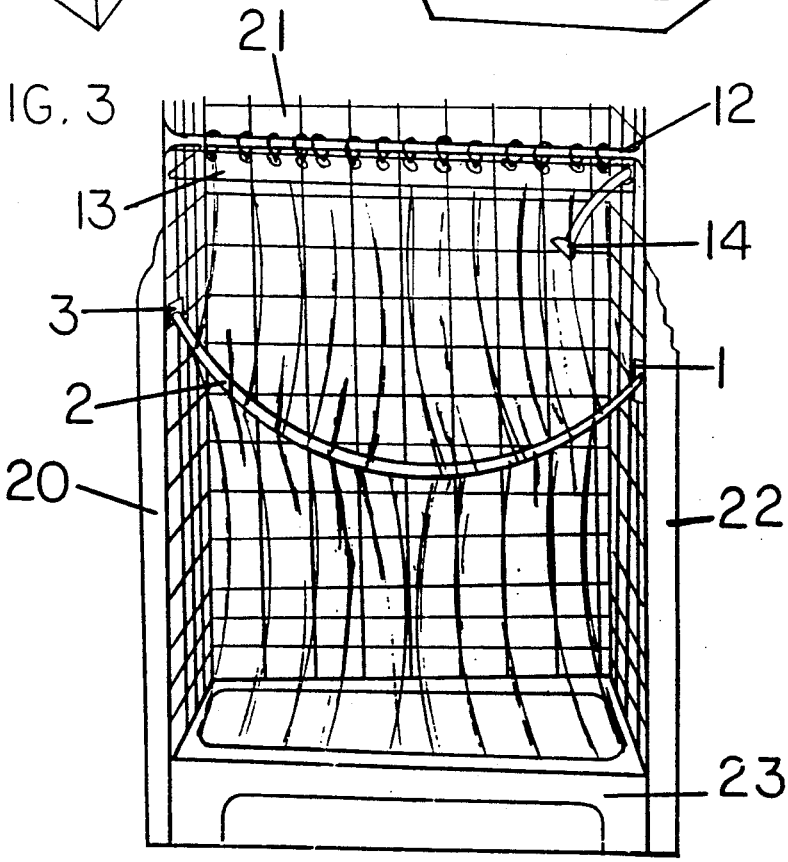
FIG. 3 is a view of a conventional tub shower installation consisting of three walls and a shower curtain hanging from a horizontal bar mounted by end supports directly above the leading edge of the tub and illustrating the present invention.

FIG. 3 shows the invention in its operative position as applied to a standard over the tub shower installation. Tub 23 is connected by three vertical walls 20, 21 and 22 and a standard shower bar 12 mounted by end supports between walls 20 and 22 about 66 inches directly above the leading edge of tub 23. With shower curtain 13 hanging from bar 12, the high impact rigid rod 2 is mounted in brackets 1 and 3 that are mounted on walls 20 and 22, 30 inches below bar 12, this will prevent the shower curtain from coming into the showering area.

Figure 4:
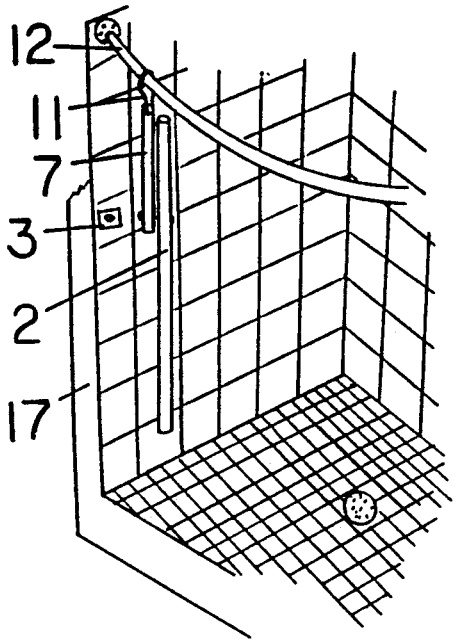
FIG. 4 is a fragmented view of FIG. 2 illustrating a shower bow hanging from the shower curtain bar in storage position showing one type of hanger.

FIG. 4, a fragmented view of FIG. 2, shows the invention in one of its storage positions hanging from bar 12 by shower curtain ring 11 supporting hanger 7 that is connected by a single bolt 8 and washer 9 to the high impact rigid rod 2 this device only supports the rod 2 in storage position.

Figure 5:
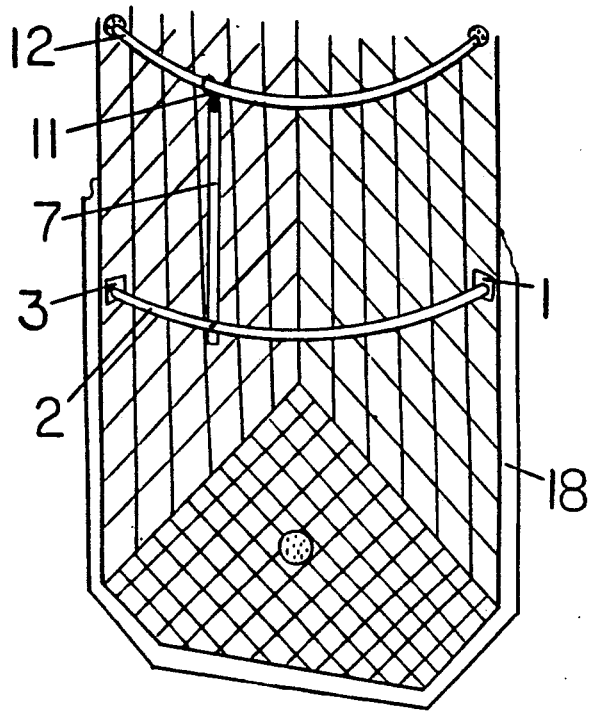
FIG. 5 is a fragmented view of FIG. 2 illustrating a shower bow with the same type of hanger as FIG. 4 in its functional configuration.

FIG. 5, a fragmented view of FIG. 2, illustrating a shower bow with the same type of storage hanger as FIG. 4 in its functional configuration by turning the rod 2, and putting it in the brackets 1 and 3. In the open position it will form a horizontal self supporting arch.

Figure 6:
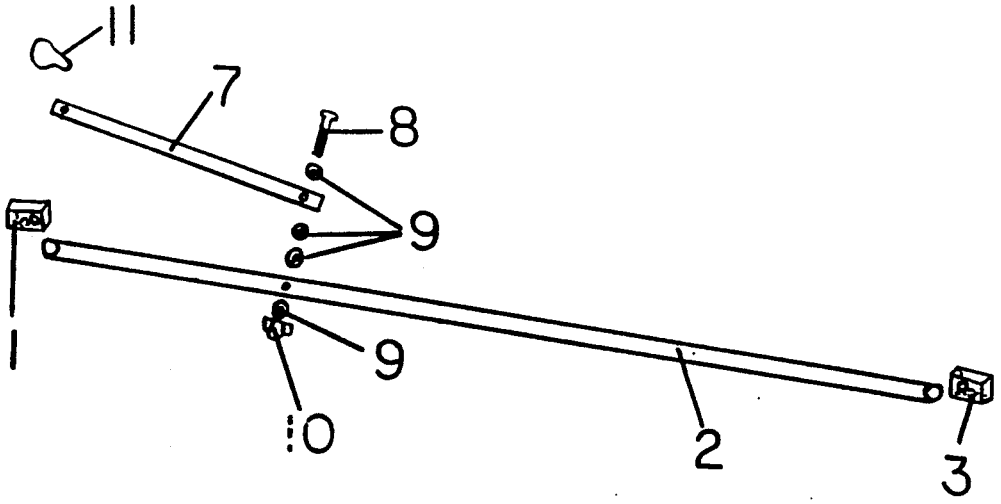
FIG. 6 is a dissected view of the shower bow with the same type of hanging device as FIG. 4 and FIG. 5.

FIG. 6 is a dissected view of the shower bow with the same type of storage hanging device as FIG. 4 and FIG. 5. Brackets 1 and 3 are of the type illustrated in FIG. 13. A high impact rigid rod 2 the diameter of which can be of any configuration. Washers 9 allow 7 and 2 to swivel. A bolt 8 connects 7, 9 and 2 at pivot point. A nut 10 that connects to 8, the hanger 7 is ⅛ by ¾ inch. by 30 inches. It can be of flexible or rigid material. The ring 11 may be one of the shower curtain rings already present and serve the function of supporting the shower curtain as well as the hanger 7 or additional ring supporting only the hanger.

Figure 7:
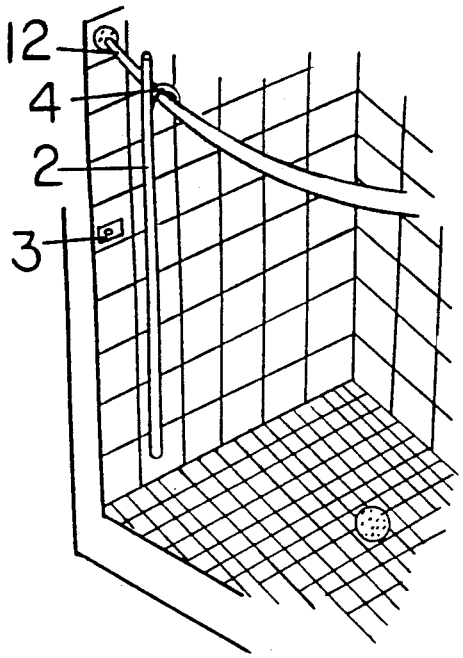
FIG. 7 is a fragmented view of FIG. 2 illustrating a shower bow hanging from the shower curtain bar in storage position showing another type of hanger.

FIG. 7, a fragmented view of FIG. 2, illustrating a shower bow hanging from the shower curtain bar 12 in another storage position. The hook type of hanger 4 is connected to the high impact rigid rod 2 at 2 inches from one end.

Figure 8:
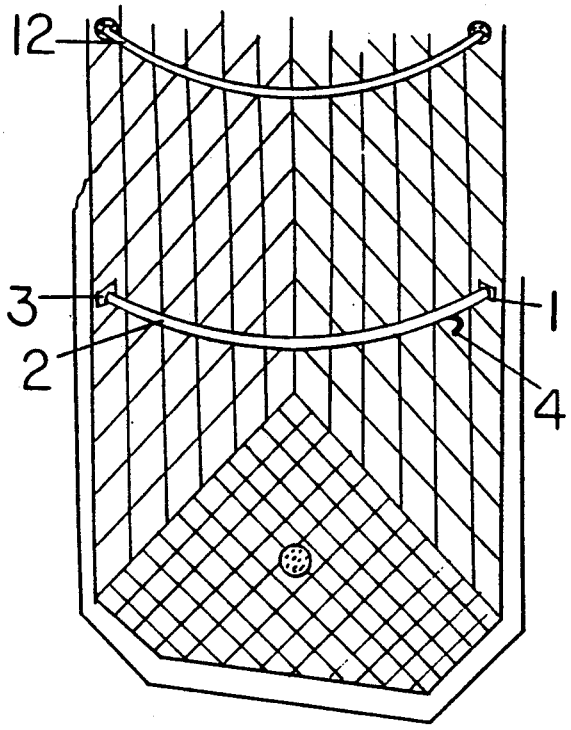
FIG. 8 is a fragmented view of FIG. 2 illustrating a shower bow with the same type of hanger as FIG. 7 in it functional configuration.

FIG. 8, a fragmented view of FIG. 2, illustrating a shower bow with the same type of hanger as FIG. 7 in its functional configuration. By lifting the rod 2 up and off bar 12 and putting it in the brackets 1 and 3 it will form a horizontal self supporting rigid arch.

Figure 9:
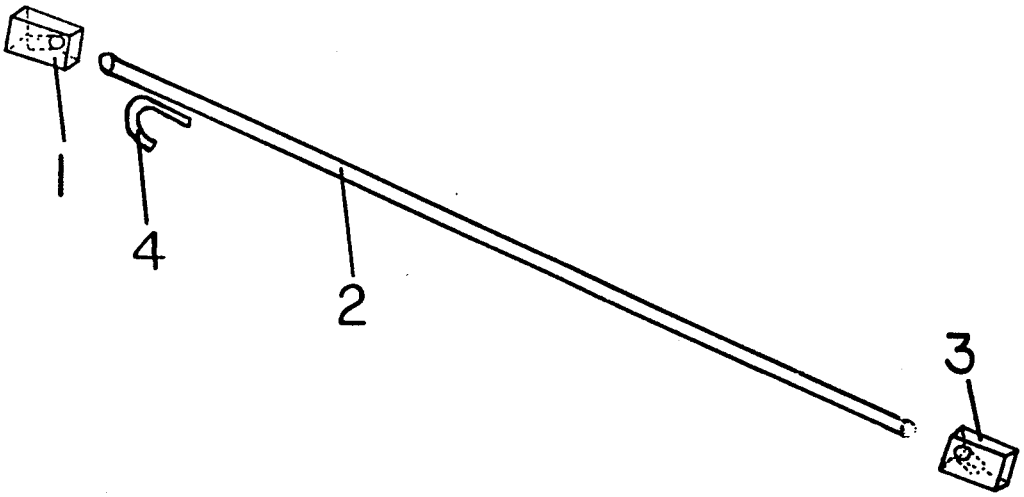
FIG. 9 is a dissected view of the shower bow with the same type of hanger device as FIG. 7 and FIG. 8.

FIG. 9 is a dissected view of the shower bow with the same type of hanger device as FIG. 7 and FIG. 8 1 and 3 are brackets of the type illustrated in FIG. 13.

Figure 10:
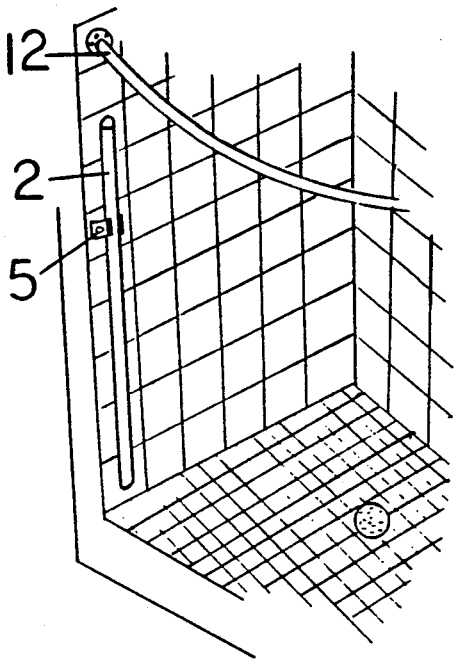
FIG. 10 is a fragmented view of FIG. 2 illustrating a shower bow hanging from the storage slot in the bracket showing still another type of hanger.

FIG. 10, a fragmented view of FIG. 2, illustrating a shower bow hanging from the storage slot in the bracket showing still another type of hanger. The bracket 5 is the same type illustrated in FIG. 14. It has a storage slot and it is mounted 30 inches below bar 12, rod 2 is put in the slot for storage.

Figure 11:
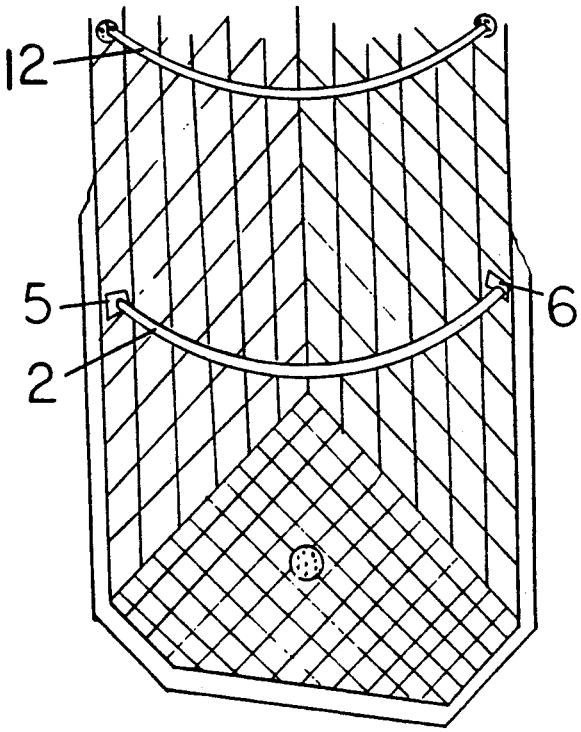
FIG. 11 is a fragmented view of FIG. 2 illustrating a shower bow with the same type of hanger as FIG. 10 in it functional configuration.

FIG. 11, a fragmented view of FIG. 2, illustrating a shower bow with the same type of hanger as FIG. 10 in its functional configuration. Rod 2 is removed from the storage slot in bracket 5 or 6 and put into brackets 5 and 6. In the open position it will form a horizontal self supporting rigid arch.

Figure 12:
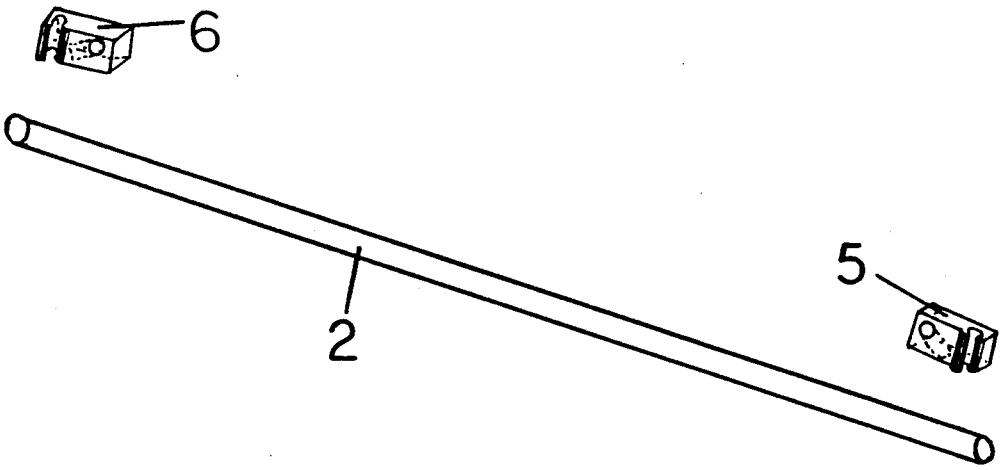
FIG. 12 is a dissected view of the shower bow with the same type of hanging device as FIG. 10 and FIG. 11

FIG. 12 is a dissected view of the shower bow with the same type of storage hanging device as FIG. 10 and FIG. 11. Brackets 5 and 6 are of the same type illustrated in FIG. 14.

Figure 13A:
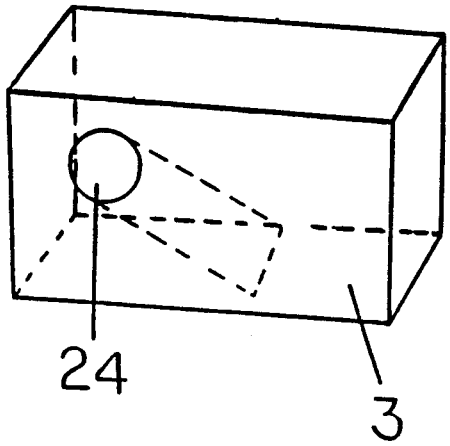
FIGS. 13*a* & 13*b* are enlarged views of brackets the same type as in FIG. 1 thru FIG. 9
Figure 13B:
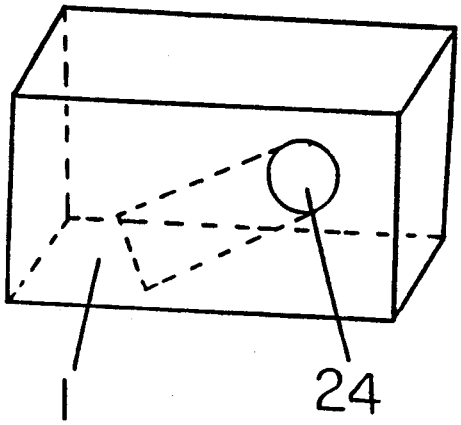

FIGS. 13*a* and 13*b* are enlarged views of brackets the same type as in FIG. 1 thru FIG. 9 The opening 24 in 3 and 1 are the same diameter configuration as rod 2 illustrated in FIG. 1 thru FIG. 9. Opening 24 goes in 1 inch at a 30% angle and down at a 10% angle.

Figure 14A:
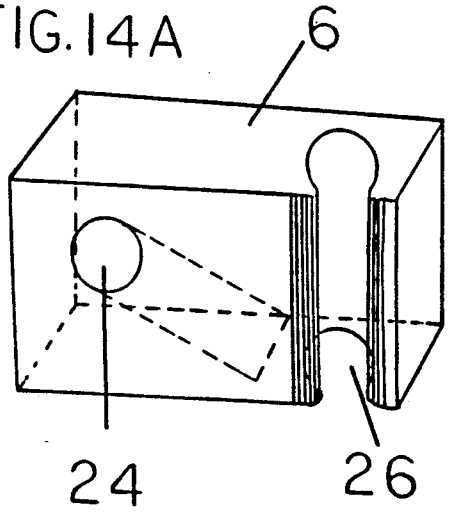
FIGS. 14*a* & 14*b* are enlarge views of brackets the same type as in FIG. 10 thru FIG. 12
Figure 14B:
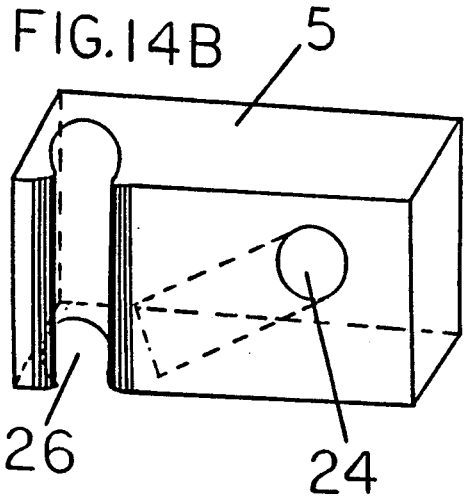

FIGS. 14*a* and 14*b* are enlarged views of brackets the same type as in FIG. 10 thru FIG. 12 The opening 24 in 6 and 7 are the same diameter configuration as rod 2 illustrated in FIG. 10 thru FIG. 12 Opening 24 goes in 1 inch at a 30% angle and down at a 10% angle. 26 is a storage slot of the same configuration as rod 2 and is vertical.

Figure 15:
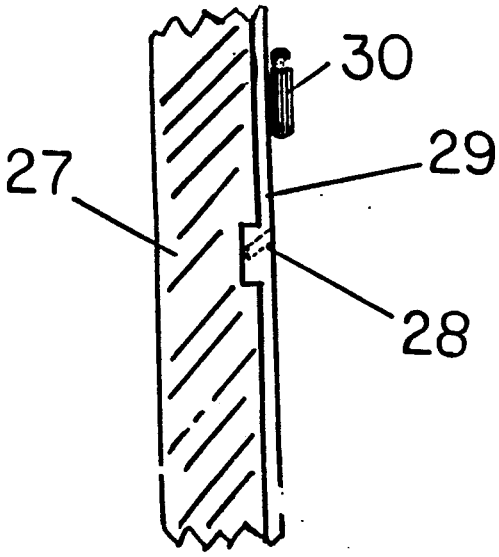
FIG. 15 is an enlarged fragmented view of vertical shower wall with molded one piece shower wall liner or sometimes called a module unit showing a built in or molded in brackets and storage slot that can be used in FIG. 1 thru FIG. 12.

FIG. 15 is an enlarged fragmented view of vertical wall 27 illustrating a one piece molded shower wall liner 29 showing a built in or molded in brackets 28 and storage slot 30.

I claim:

1. A shower bow apparatus, for use with a shower curtain bar and shower curtain to provide a rigid arch which prevents said shower curtain from entering a showering area, comprising:

a pair of brackets for attaching to walls of said showering area, each of said brackets having an angled bore;

a separate rigid high impact rod longer than said bar;

a rod storage device integral with said shower bow apparatus, comprising a hanger hook attached to one end of said rod so as to hang said rod from said shower curtain bar when in unbowed condition; and wherein said angled bores are equal in size and shape to the cross-section of said rod, whereby the ends of said rod are inserted into each respective bracket bore to fully support said rod when bowed into a horizontal rigid arch.

2. A shower bow apparatus, for use with a shower curtain bar and shower curtain to provide a rigid arch which prevents said shower curtain from entering a showering area, comprising:

a pair of brackets for attaching to walls of said showering area, each of said brackets having an angled bore;

a separate rigid high impact rod longer than said bar;

a rod storage device integral with said shower bow apparatus, comprising a vertical storage slot in each one of said brackets of a diameter to provide an interference fit to said rod so as to hold said rod vertically when in unbowed condition; and wherein said angled bores are equal in size and shape to the cross-section of said rod, whereby the ends of said rod are inserted into each respective bracket bore to fully support said rod when bowed into a horizontal rigid arch.

3. A shower bow apparatus, for use with a shower curtain bar and shower curtain to provide a rigid arch which prevents said shower curtain from entering a showering area, comprising:

a pair of brackets for attaching to walls of said showering area, each of said brackets having an angled bore;

a separate rigid high impact rod longer than said bar;

a rod storage device integral with said shower bow apparatus, comprising a ring around said shower curtain bar attached to one end of a supporting hanger rod, said hanger rod being one third the length of the shower curtain, the other end of said hanger rod pivotally attached with a single bolt to said rigid rod, so as to hold rod vertically when in unbowed condition; and wherein said angled bores are equal in size and shape to the cross-section of said rod, whereby the ends of said rod are inserted into each respective bracket bore to fully support said rod when bowed into a horizontal rigid arch.

* * * * *